United States Patent [19]

Ishikawa et al.

[11] Patent Number: 4,869,224

[45] Date of Patent: Sep. 26, 1989

[54] IN-ENGINE DEPOSIT DETECTION APPARATUS FOR ENGINE CONTROL SYSTEM

[75] Inventors: Hideaki Ishikawa; Osamu Abe, both of Katsuta; Aiichi Uehara, Tsuyama, all of Japan

[73] Assignees: Hitachi, Ltd.; Hitachi Automotive Eng. Co., both of Tokyo, Japan

[21] Appl. No.: 225,354

[22] Filed: Jul. 28, 1988

[30] Foreign Application Priority Data

Jul. 30, 1987 [JP] Japan ..... 62-188865

[51] Int. Cl.[4] ..... F02D 41/14

[52] U.S. Cl. ..... 123/489; 123/440; 123/480

[58] Field of Search ..... 123/489, 440, 480, 339, 123/492, 493; 73/23

[56] References Cited

U.S. PATENT DOCUMENTS 4,796,590 1/1989 Degobart et al. ..... 123/489

*Primary Examiner*—Raymond A. Nelli

*Attorney, Agent, or Firm*—Antonelli, Terry & Wands

[57] ABSTRACT

An in-engine deposit detection apparatus for an engine control system is disclosed, comprising a sensor for detecting the output air-fuel ratio of the exhaust gas, a device for controlling the fuel supply amount according to the output air-fuel ratio from the sensor, acceleration detector for detecting a time point when an acceleration command is given the engine, a device for measuring a value based on the time length from a command time point detected by the acceleration detector to a time point that the sensor detects the shift of the output air-fuel ratio to rich side, a device for giving a reference value defining a limit of a normal range of the measurement obtained on the basis of the time length from the command time point detected by the acceleration detection means to the time point when the sensor detects that the output air-fuel ratio has shifted to rich side, and a device for comparing the measurement from the measuring means with a reference and deciding that there exists a deposit having an adverse effect on the engine control when the measurement deviates from the normal range defined by the reference value.

14 Claims, 5 Drawing Sheets

IN-ENGINE DEPOSIT DETECTION APPARATUS FOR ENGINE CONTROL SYSTEM

BACKGROUND OF THE INVENTION

The present invention relates to an in-engine deposit detection apparatus for an engine control system, or more in particular to an in-engine deposit detection apparatus attached to a control system for a gasoline engine with fuel injected into intake manifold.

As a method of mixture gas supply to a gasoline engine, a system for injecting the fuel directly into the intake manifold, that is, what is called the intake manifold fuel injection system is well known and finds wide applications.

In this type of engine, however, a deposit containing carbon as a main component is often formed in the intake manifold, resulting in "carbon hesitation", a phenomenon in which the engine control "falters" or becomes inefficient, thereby deteriorating the drivability.

The conventional engine control systems have paid no special attention to the detection of a deposit in the intake manifold and therefore have had a problem of the difficulty of taking satisfactory measure against the deterioration of the drivability caused by carbon hesitation.

SUMMARY OF THE INVENTION

The object of the present invention is to provide an in-engine deposit detection apparatus for an engine control system which detects that the amount of the deposit in the intake manifold has increased to such an extent as to have an adverse effect on the engine control thereby to provide against the deterioration of drivability.

According to the present invention, there is provided an in-engine deposit detection apparatus for an engine control system comprising means for detecting that a measurement obtained on the basis of a time lag from a time point when the supply air-fuel ratio determined by the intake air flow rate and the fuel injection amount changes to rich side to a time point when the output air-fuel ratio detected from the exhaust gas composition changes to rich side has deviated from the range of measurements based on normal time lag, thereby detecting that the deposit has increased to such an extent as to have an adverse effect on the engine control.

DESCRIPTION OF THE PREFERRED EMBODIMENTS

Figure 1:
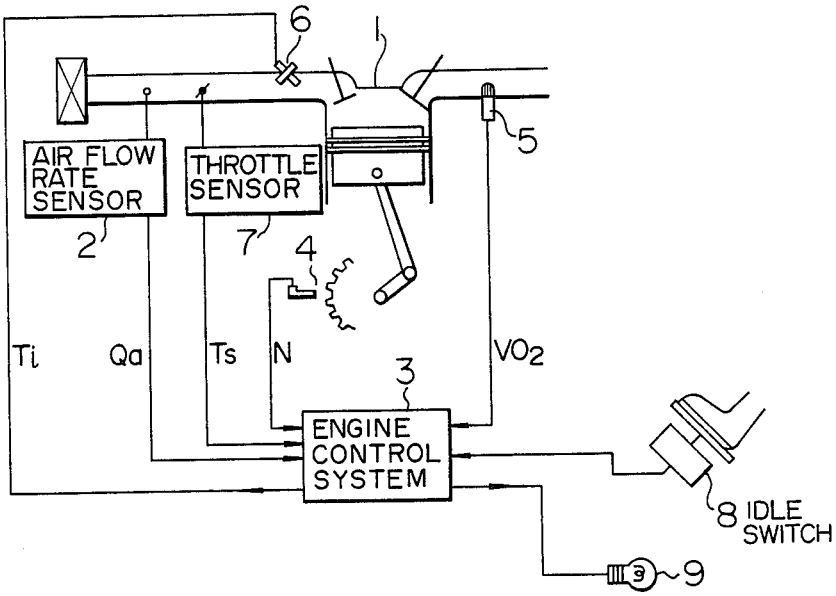
FIG. 1 is a configuration diagram showing an engine control system according to an embodiment of the present invention.

A well known oxygen sensor for detecting an output air-fuel ratio according to an embodiment of the present invention is shown in FIG. 1. In FIG. 1, let $Q_A$ be the air amount introduced into the cylinder of an engine 1 through an air filter 10. The value $Q_A$ is measured by an air flow rate sensor 2 and is supplied to an engine control system 3 controlled by a microcomputer. The engine speed N is determined by the engine control system 3 counting the pulses generated at intervals of a predetermined angle from a crank angle sensor 4 rotating in synchronism with the engine. From the intake air amount $Q_A$ and the engine speed N, the pulse width $T_P$ for basic fuel injection required of the engine is determined from the equation below.

$$T_P = K \times Q_a / N \quad (1)$$

where $T_P$ is the basic pulse width, K a constant, $Q_A$ an intake air amount, and N the engine speed.

Figure 2:
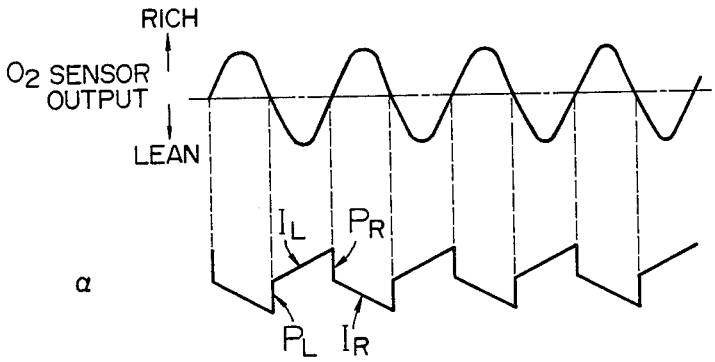
FIG. 2 is a diagram for explaining the operation of an oxygen sensor according to an embodiment of the present invention.

An oxygen sensor 5 mounted in the exhaust pipe, on the other hand, is for generating a signal $VO_2$ in response to the oxygen concentration in the exhaust gas. On the basis of this signal, the basic fuel injection pulse width $T_P$ is compensated, and the fuel injection pulse width $T_i$ to be actually supplied to an injector 6 is calculated, thereby effecting the feedback control of the fuel injection amount. The fuel injection pulse width $T_i$ is determined from the equation below. The injector 6 injects fuel at intervals of the pulse width $T_i$.

$$T_i = T_P \times \alpha \times (1 + K_A + K_1) \quad (2)$$

where $T_i$ is the fuel injection pulse width, $\alpha$ a feedback compensation factor, $K_{AC}$ an acceleration compensation factor, and $K_1$ various compensation factors. The value $\alpha$ in equation (2) is for proportional integration control as shown in FIG. 2 by use of the output $V0_2$ of the oxygen sensor 5. Specifically, if the air-fuel ratio changes from lean to rich side, the proportion $P_R$ is subtracted from the feedback compensation factor, followed by progressive decrement of the integration $I_R$. When the air-fuel ratio changes from rich to lean side, on the other hand, the proportion $P_L$ is added, followed by progressive increment by the integration $I_L$. $K_{AC}$ is a factor for compensating the fuel injection time upward upon detection of an acceleration by various sensors. $K_1$ is a factor corrected in accordance with the various engine conditions including the start, battery voltage and water temperature. A proper fuel injection pulse width $T_1$ suitable to each operating condition is obtained from equation (2). The aforementioned method of calculating the fuel injection pulse width thereby to control the fuel injection is described in "Automotive Engineering", 1986, Vol. 35, No. 7, pp. 152 to 161 published by Tetsudo Nihonsha.

If carbon or other deposits derived from secular variations or substandard gasoline attach on the wall of the intake manifold or intake valve, part of the gasoline injected to the deposits is absorbed into them or released from them, with the result there occurs a kind of lag between the supply air-fuel ratio and the output air-fuel ratio. During the acceleration when the supply air-fuel ratio shifts to rich side, in particular, the output air-fuel ratio develops a time lag. While the vehicle is accelerating, therefore, the carbon hesitation (falter)

makes satisfactory engine control difficult merely with the fuel injection pulse width $T_1$ calculated from equation (2), thus deteriorating the drivability.

According to the present invention, the time lag of the output air-fuel ratio behind the supply air-fuel ratio in shifting to the rich side is determined to obtain a detection value proportional to the amount of deposits including carbon. When this detection value exceeds a predetermined value, the amount of the deposits is regarded to have increased to such an extent as to adversely affect the engine control. The user is thus warned by an alarm lamp 9 to carry out the maintenance. Further, before the maintenance work is started, the compensation factor $K_{AC}$ is used to improve the drivability.

First, explanation will be made about a method of detecting the deposits such as carbon. In the embodiment under consideration, an idle switch 8 is used. When this switch 8 turns from ON (idle state) to OFF (partial state), that is, while the vehicle is accelerating, the carbon deposit amount is detected in the manner described below.

Figure 3:
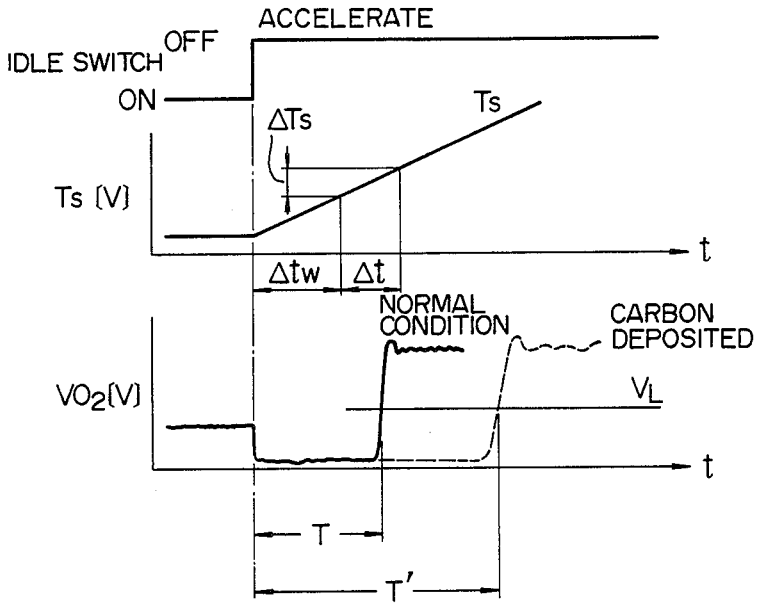
FIG. 3 is a time chart for explaining the operation of an embodiment of the present invention.
Figure 4:
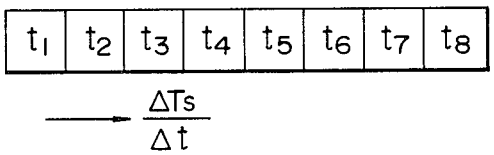
FIG. 4 is a decision time map for explaining the present invention.

While the vehicle is accelerating, a lag in the fuel system causes the oxygen sensor output $V_{02}$ to shift to lean side once, followed by shifting to rich side. In FIG. 3, the delay time T indicated by solid line, which is normal, is delayed as shown by dotted line with time T' lengthened. During the acceleration, the time is measured before the oxygen sensor output exceeds a predetermined slice level $V_L$ from lean side. This time measured is compared with a predetermined criterion $t_n$. If the time measurement T is smaller than or equal to $t_n$, it is decided that the situation is normal, while if T is larger than $t_n$, it is decided that the amount of carbon deposit has increased to such a degree as to adversely affect the engine control. The criterion $t_n$ is prepared in the form of the eight types $t_1$ to $t_8$ as shown in FIG. 4. This is by reason of the fact that since the delay time T varies with the operating conditions (sharp acceleration, slow acceleration, etc.), the operating region is divided into eight parts according to the change rate $\Delta T_S/\Delta t$ per unit time $\Delta t$ of the output voltage $T_S$ of the throttle sensor 7 indicating the throttle opening degree, that is, the accelerator pedal depression rate, so that the criterion $t_n$ is provided for each of the eight operating regions, out of which a predetermined one is selected for decision. The change rate $\Delta T_S/\Delta t$ is determined, as shown in FIG. 3, by measuring the increment $\Delta T_S$ of the throttle sensor output $T_S$ within a small time $\Delta t$ after the lapse of a short time $\Delta T_W$ following the turning on of the idle switch 8. The time delay T for the change rate thus determined is obtained empirically, thus designating the criterion $t_n$ for each of the eight regions as shown in FIG. 4.

As a consequence, according to this embodiment, the time measurement may be compared for each operating region and a highly accurate decision is made possible.

In this way, when T becomes larger than $t_n$, the alarm lamp 9 is lit to urge the user to conduct the appropriate maintenance work. In the meantime, the acceleration compensation factor $K_{AC}$ is increased to prevent the deterioration in drivability.

The above-mentioned control procedure which is implemented by the engine control system 3 will be described more in detail with reference to the flowchart of FIG. 5.

This flowchart is started at intervals of 10 msec to retrieve the intake air amount $Q_A$, engine speed N, oxygen sensor voltage $VO_2$, throttle sensor voltage $T_S$ and calculate the basic fuel injection pulse width $T_P$, feedback compensation factor $\alpha$, acceleration compensation actor $K_{AC}$ and various compensation factors $K_1$ (step 101).

In the next step 102, the time of turning off of the idle switch 8 (accelerator pedal on) is decided. When the idle switch 8 is other than off, the process proceeds to step 109 to calculate $T_i$. When the idle switch 8 is off, on the other hand, the time T required for shifting from the time of turning off of the idle switch 8 to the time of transfer from lean to rich side of the oxygen sensor output is measured. Further, the criterion time $t_n$ (n: 1 to 8) is selected from the change rate of the throttle sensor voltage $T_S$ by the classification of FIG. 4. The value T is compared with $t_n$ (step 104), and if T is larger than $t_n$, the up-down counter is incremented (step 105). Further, the value of the counter N is compared with a predetermined value M (step 106). The counter N is used for preventing a faulty decision operation on T and $t_n$ and decides that carbon has been deposited only after the condition of $T > t_n$ is satisfied a number M of times. Normally, M is set to the value of 3 to 5.

If step 106 decides that N is smaller than M, the process proceeds to step 109 for calculating the pulse width $T_i$. If N is larger than or equal to M, N is set equal to M at step 107, after which the NG flag is set to light the alarm lamp 9. At the same time, $K_{AC}$ is multiplied by a predetermined value $\beta$ as $K_{AC}=\beta K_{AC}$ thereby to increase the value $K_{AC}$. The basic injection pulse width $T_i$ is thus calculated (step 109). The value of $\beta$ is normally selected at 1.1 to 1.3.

Figure 5:
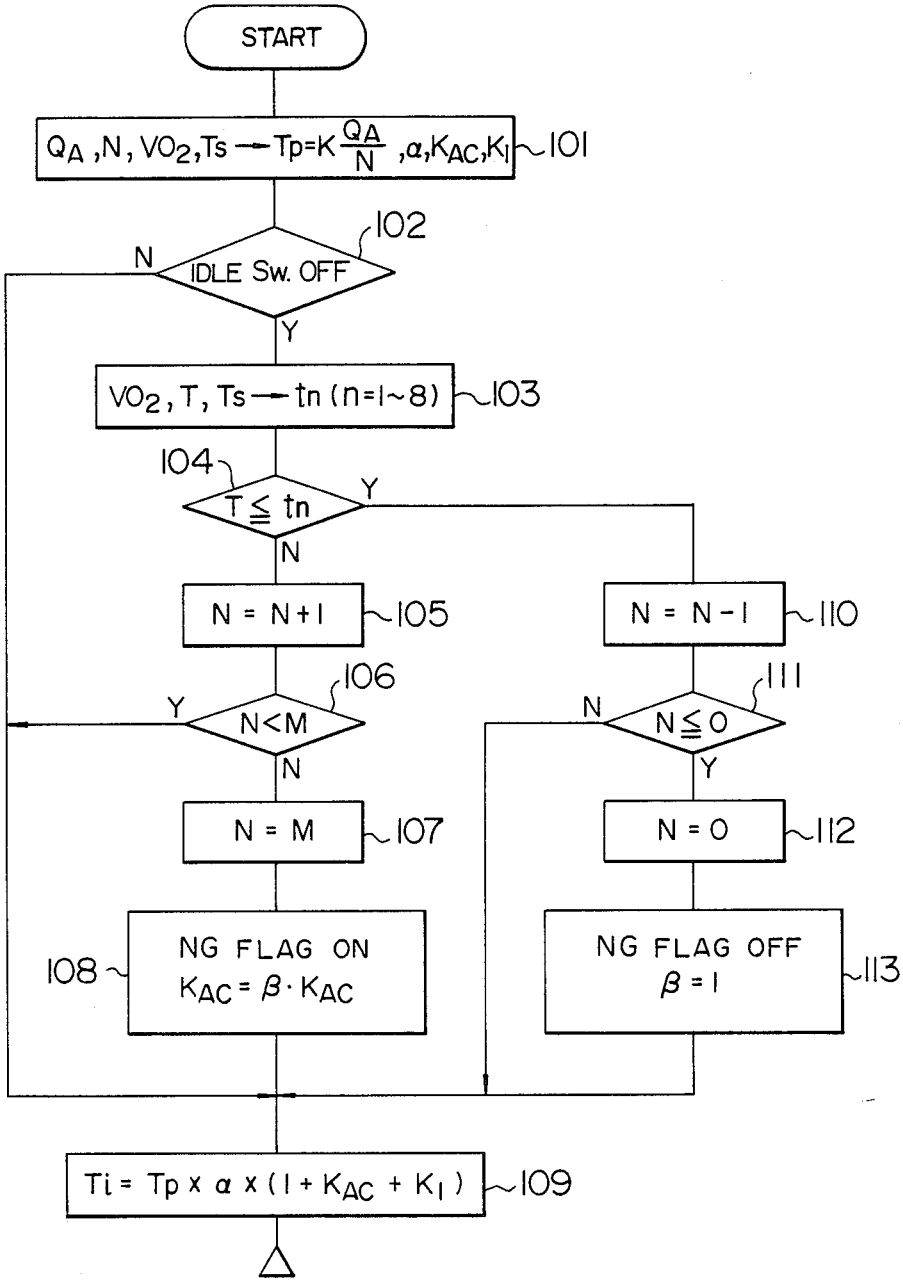
FIG. 5 is a flowchart showing the operation of an embodiment of the present invention.

Under normal conditions or after completion of maintenance, the decision at step 104 becomes "yes", and the process proceeds to the routine on the right side in FIG. 5, where the counter N is decremented (step 110). When N is smaller than or equal to zero (step 111), N is fixed to zero (step 112), and the NG flag is reset, thereby setting $\beta$ to 1 (step 113).

According to the present invention, as mentioned above, the amount of carbon deposit is detected and it is decided whether the amount of carbon deposit has increased to such an extent as to have an adverse effect on the engine control. If the measured time T is more than a predetermined value $t_n$, the user is warned to promote the maintenance work. Further, during the period from the detection of a carbon deposit to the time of maintenance, an acceleration compensation is effected thereby to prevent carbon hesitation. After the NG flag is turned off at step 113, this NG flag may be read at the time of maintenance to inform the user of the need of removal of the deposit, thereby eliminating the warning to the user.

Another embodiment of the present invention will be explained below.

Figure 6:
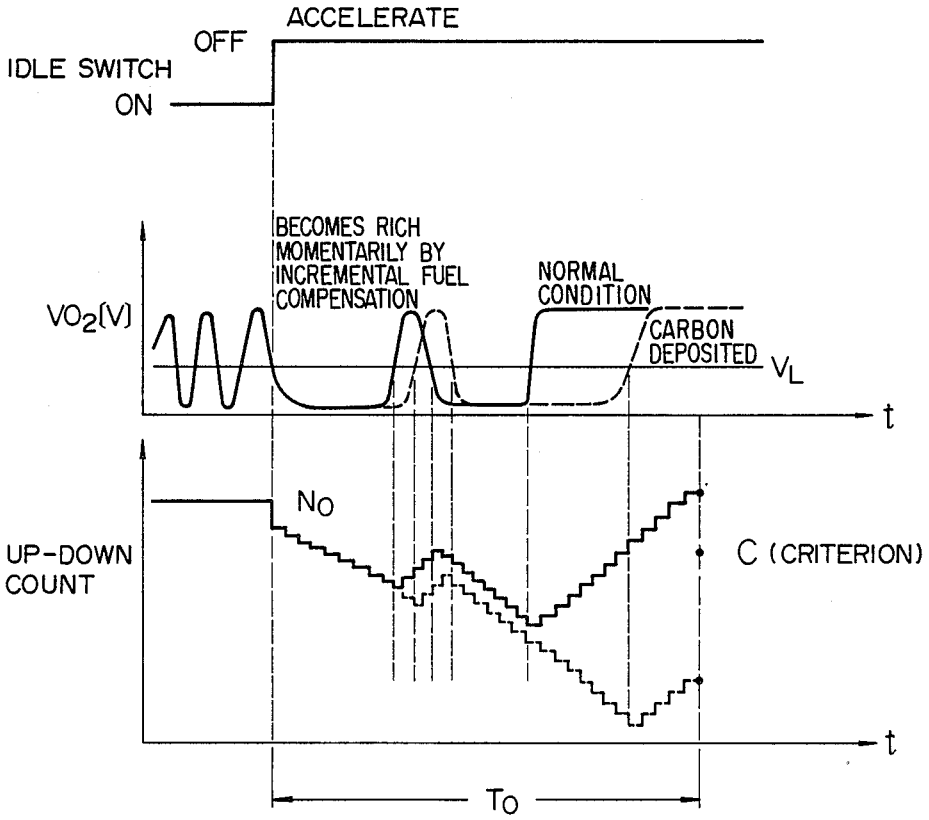
FIG. 6 is a time chart for explaining the operation of another embodiment of the present invention.

In this embodiment provided with an up-down counting function, as shown in FIG. 6, upon detection of an acceleration by an idle switch 8, the up-down counter count down clocks of predetermined period if the output $V0_2$ of the oxygen sensor 5 is on lean side, while the up-down counter counts up the clock if the output air-fuel ratio on the output $V0_2$ is on rich side. It is decided whether the carbon or other deposit has increased to such an amount as to have an adverse effect on the engine control according to whether the count $N_{DU}$ of the up-down counter is larger or smaller than a predetermined value C after the lapse of a set criterion time $T_0$ following the detection of an acceleration. The criterion time $T_0$ and the value C are determined after a multiplicity of experiments conducted on several sample vehicles. Depending on the vehicle models, the criterion time $T_0$ is set to about 1 to 2 secs in view of the rise time of about 1 sec from lean to rich state under normal conditions.

Specifically, according to this embodiment, it is decided whether the deposit has reached a limit according to how the count $N_{DU}$ of an up-down counter set to a count value $N_0$ stands against the criterion value C after the lapse of a predetermined period of time $T_0$.

$N_{DU} \geqq C \rightarrow$ No adverse effect of deposit $N_{DU} < C \rightarrow$ Adverse effect of deposit As explained with reference to the foregoing embodiment, some engine control systems effects an upward compensation of the fuel during acceleration. In such a case, $VO_2$ becomes rich momentarily, and in the embodiment of FIG. 3, a delay time may be undesirably detected in response to the instantaneous rise to rich state, often resulting in a faulty operation of carbon deposit detection.

According to the embodiment of FIG. 6, by contrast, the decision is made by an integration of the time when the output $V0_2$ of the oxygen sensor 5 becomes rich and lean, and therefore is not substantially affected by the instantaneous incremental control such as acceleration compensation. A fully accurate control is thus obtained.

Now, the embodiment shown in FIG. 6 will be explained with reference to the flowchart of FIG. 7.

Figure 7:
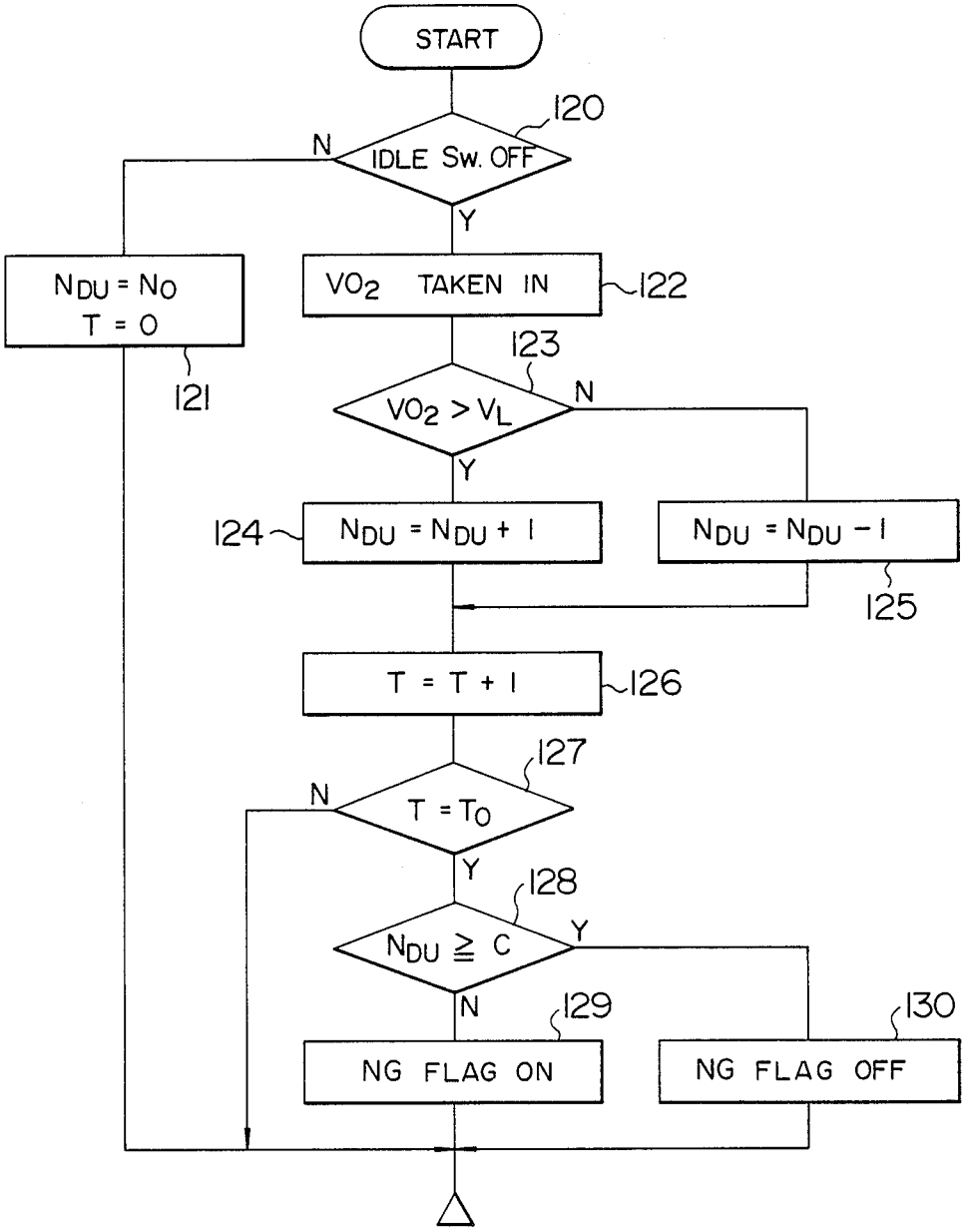
FIG. 7 is a flow chart showing the operation of the embodiment shown in FIG. 6.

The routine shown in FIG. 7 is started at regular intervals of 10 msec to decide whether the idle switch 8 is off or not (step 120). If the decision is ON, an integration up-down counter $N_{DU}$ and a time counter T are reset to zero (step 121) to end this routine.

If step 120 decides that the idle switch 8 is off, only the oxygen sensor takes the output voltage $V0_2$ (step 122), which is then compared with a slice level $V_L$ (step 123). If $V0_2$ is larger than $V_L$, the up-down counter $N_{DU}$ is incremented (step 124), while if $VO_2$ is smaller than or equal to $V_L$, the up-down counter $N_{DU}$ is decremented (step 125). The time counter T is then incremented (step 126) and it is decided whether the time count T has become equal to a predetermined value $T_0$ (step 127). If T is not $T_0$, this routine is ended, while if T is equal to $T_0$, the integration value $N_{DU}$ of the up-down counter is compared with a predetermined value C (step 128). If the decision is that $N_{DU}$ is larger than or equal to C, the condition is normal, and therefore the NG flag is set to OFF. If $N_{DU}$ is smaller than C, by contrast, it is decided that the deposit amount has exceeded a limit, and the NG flag is turned ON.

In place of the oxygen sensor for detecting an output air-fuel ratio in the embodiments mentioned above, other types of air-fuel ratio sensors may of course be used embody the invention. Also, instead of deciding on an acceleration when the idle switch is off, the fact that $\Delta T_s/\Delta t$ is a positive value or larger than a predetermined value may be detected alternatively to decide on an acceleration. In this case, step 102 of FIG. 5 or step 120 of FIG. 7 is changed to decide whether $\Delta T_s/\Delta t$ is larger than zero or not.

It will thus be understood from the foregoing description that according to the present invention, a carbon or other deposit in an engine intake system is detected with sufficient accuracy, and therefore an always proper maintenance and a proper compensation for the fuel supply amount by acceleration are possible, thus making it possible to prevent the deterioration of the drivability in satisfactory manner.

We claim:

1. An in-engine deposit detection apparatus for an engine control system, comprising:
   - a sensor for detecting an output air-fuel ratio of an engine from the exhaust gas thereof;
   - an engine control system for controlling the fuel supply amount on the basis of the output air-fuel ratio detected by the sensor;
   - acceleration detection means for detecting the time when an acceleration command is given to the engine;
   - means for measuring a value based on a time length from a time point detected by the detection means to a time point of detection by said sensor that the output air-fuel ratio has shifted to rich side;
   - means for giving a reference value defining a limit of a normal range of the measurement obtained on the basis of the time length from a time point detected by the detection means to a time point when the sensor in the process of normal operation detects that the output air-fuel ratio has shifted to rich side; and
   - means for comparing the measurement from the measuring means with the reference value from the reference value means, and deciding that there exist a deposit having an adverse effect on the engine control when the measurement deviates from a normal range defined by the reference value.

2. An apparatus according to claim 1, wherein said acceleration detection means is means for detecting that the accelerator pedal has moved in the direction of depression thereof.

3. An apparatus according to claim 2, wherein said accelerator pedal motion detection means is an idle switch for detecting that an idle state has changed to a partial state.

4. An apparatus according to claim 2, wherein said accelerator pedal motion detection means is speed-up indication means for detecting an indication from a fixed speed drive to an accelerated drive.

5. An apparatus according to claim 4, wherein said speed-up indication means includes a throttle sensor for detecting the throttle opening degree and means for detecting that the change rate from the throttle sensor is positive.

6. An apparatus according to claim 5, wherein said positive change rate detection means is means for detecting that the detection value from the throttle sensor is larger than a predetermined value.

7. An apparatus according to claim 1, wherein said measuring means is means for detecting the time length from said command time point to said shift detection time point, and said reference value means is means for giving a value determining a limit of a normal range of the time length from the command time point detected by the detection means to a time point when the sensor detects the shift of the output air-fuel ratio to rich side under normal conditions.

8. An apparatus according to claim 7, wherein the time measuring means includes means for determining a predetermined level between the lean and rich sides of the output air-fuel ratio, and means for detecting the shift detection time point as a time point when the output air-fuel ratio has crossed the predetermined level from lean to rich side.

9. An apparatus according to claim 1, wherein said measuring means includes means for setting a predetermined time width longer than the time length from the command time point detected by said detection means to the time point when said sensor detects that the output air-fuel ratio has shifted to rich side, and an up-down counter for counting selected one of up and down when the output air-fuel ratio is on lean side and counting the other of up and down when the output air-fuel ratio is on rich side thereby to provide said measurement as a count from the command time point, said reference value means being means for giving a count defining a limit of a normal range of the value counted by the up-down counter under normal conditions within a predetermined time width produced from the time width setting means.

10. An apparatus according to claim 9, wherein said time width setting means is means for setting said predetermined time width as a time length longer than the limit time of the normal range of the time measurement from the command time point detected by said detection means to the time point when the sensor detects that the output air-fuel ratio has shifted to rich side under normal conditions.

11. An apparatus according to claim 1, further comprising means for storing the result of a decision that may be made by said decision means to the effect that there exists a harmful deposit.

12. An apparatus according to claim 1, further comprising means for storing the result of a decision that may be made by said decision means to the effect that there exists a harmful deposit.

13. An apparatus according to claim 1, further comprising compensation means for compensating for the fuel injection amount of the engine control system when the decision means decides that there exists a harmful deposit.

14. An apparatus according to claim 13, wherein said compensating means is means for compensating by incrementing the fuel injection amount.

* * * * *